United States Patent [19]

Vincent et al.

[11] Patent Number: 4,999,793

[45] Date of Patent: Mar. 12, 1991

[54] MICROCOMPUTER REAL-TIME FLASH X-RAY CONTROLLER FOR DATA ACQUISITION

[75] Inventors: Philip M. Vincent, Hyde Park; Albert L. Chang, Lexington, both of Mass.; Ivan A. Martorell, Delmont, Pa.

[73] Assignee: The United States of America as represented by the Secretary of the Army, Washington, D.C.

[21] Appl. No.: 322,596

[22] Filed: Mar. 13, 1989

[51] Int. Cl.[5] ..... G04F 1/00; G06M 3/02

[52] U.S. Cl. ..... 364/569; 364/516; 377/9

[58] Field of Search ..... 364/550, 569, 516; 377/2, 9

[56] References Cited

U.S. PATENT DOCUMENTS 4,385,227 5/1983 Bridges ..... 377/20 X

OTHER PUBLICATIONS

"Development of an Automatic, Velocity-Independent Flash X-Ray Triggering System", L. R. Ford et al, Proc. of the 1986 Flash Radiography Topical.

"Microcomputer Real Time Flash X-Ray Controller", A. L. Chang, P. M. Vincent, and I. A. Martorell, 39th Meeting of the Aeroballistic Range Association, Oct. 11, 1988.

*Primary Examiner*—Parshotam S. Lall
*Assistant Examiner*—Edward R. Cosimano
*Attorney, Agent, or Firm*—Richard J. Donahue

[57] ABSTRACT

A microcomputer-based real-time flash x-ray controller, which completely eliminates the "guesswork" in capturing projectiles on radiographs. The microcomputer measures the projectile velocity with high precision, calculates the correct delays in real-time and sends out appropriate triggering pulses to activate the x-ray tubes, arbitrarily arranged along the projectile flight path, to capture the projectile on radiographs at desired locations. The system imposes virtually no restrictions on x-ray tube locations downrange. It is software driven, user friendly and fully programmable for various ballistic range set-ups and it can be easily adapted to synchronize the time-critical controls of other equipment such as high speed cameras, target instrumentations, and the like. The use of a personal computer, centralizes the range operations as equipment control and experiment record-keeping become an integral task.

9 Claims, 2 Drawing Sheets

MICROCOMPUTER REAL-TIME FLASH X-RAY CONTROLLER FOR DATA ACQUISITION

The invention described herein may be manufactured, used and licensed by or for the Government for Governmental purposes without the payment to us of any royalty thereon.

BACKGROUND OF THE INVENTION

This invention relates to a personal computer (PC) based system used to measure projectile velocity and perform real-time precision triggering of multiple flash X-ray equipment widely used for in-flight diagnostics of ballistics projectiles. This flash X-ray equipment can be located randomly along the flight path of the projectile.

A flash x-ray is like an electronic flash for photography and produces a very intense energy burst in a very short period of time. This allows the photographing of an event which lasts for a very short period of time with x-rays, and also provides the possibility of making images behind opaque objects. In such devices, the x-ray tube is installed in the tube heads. The remote tube head is the most common configuration in a ballistic environment.

Various methods are available for triggering pulsed radiation systems to observe high speed events such as aluminum foil penetration or "Make Screen", or a normally closed foil circuit or "Break Screen." The break screen may be provided by an electrical circuit which is interrupted by the projectile and generates a trigger pulse. This can be made using an etched metallic line on an insulating paper which is interrupted by impact of the projectile.

The standard method of triggering flash x-ray to capture the in-flight projectile on radiographs has been to predict the velocity of the projectile before it is fired and to set up the delay times for triggering the x-ray tubes by delay generators according to this predicted velocity. The entire success of the radiograph thus depends on the accuracy of that velocity prediction. A more advanced system is described in "Development of an Automatic, Velocity-Independent Flash X-Ray Triggering System" by Lindy R. Ford and James D. Moravec, Sr., U.S. Army Yuma Proving Ground, Yuma, AZ, (1986) in *1986 Flash Radiography Topical,* The American Society For Nondestructive Testing, Inc., edited by Edwin A. Webster, Jr. and Alfred M. Kennedy, in which flash X-Rays are taken of projectiles which are independent of velocities [which was the problem with prior apparatus]. However, this system did not permit random placement of the stations at which the flash X-rays are taken. It will be seen that the current invention however, allows the x-ray heads to be located randomly at several locations, called action stations, along the flight path of the projectile.

SUMMARY OF THE INVENTION

The current invention, a microcomputer-based real-time flash x-ray controller, completely eliminates the "guesswork" in capturing projectiles on radiographs. The microcomputer measures the projectile velocity with high precision, calculates the correct delays in real-time and sends out appropriate triggering pulses (action steps) to activate the x-ray tubes which are arbitrarily arranged along the projectile flight path, to capture the projectile on radiographs at desired locations, called action stations. The present system has been tested over a wide range of velocities (1,500–6,500 fps) and imposes virtually no restrictions on x-ray tube locations downrange. Since the system is totally microcomputer-based, it is superior to other real-time controllers using divide-by-n counter/timers as these set-ups impose stringent restrictions on the possible x-ray tube locations downrange.

The current invention can be software driven, and fully programmable for various ballistic range set-ups and it can be easily adapted to synchronize the time-critical controls of other equipment such as high speed cameras, target instrumentations, etc. Since the system uses a particular application of a personal computer, the full capacity of the personal computer is also available to centralize the range operations as equipment control and experiment record-keeping become an integral task.

DETAILED DESCRIPTION OF THE PREFERRED EMBODIMENTS

Figure 1:
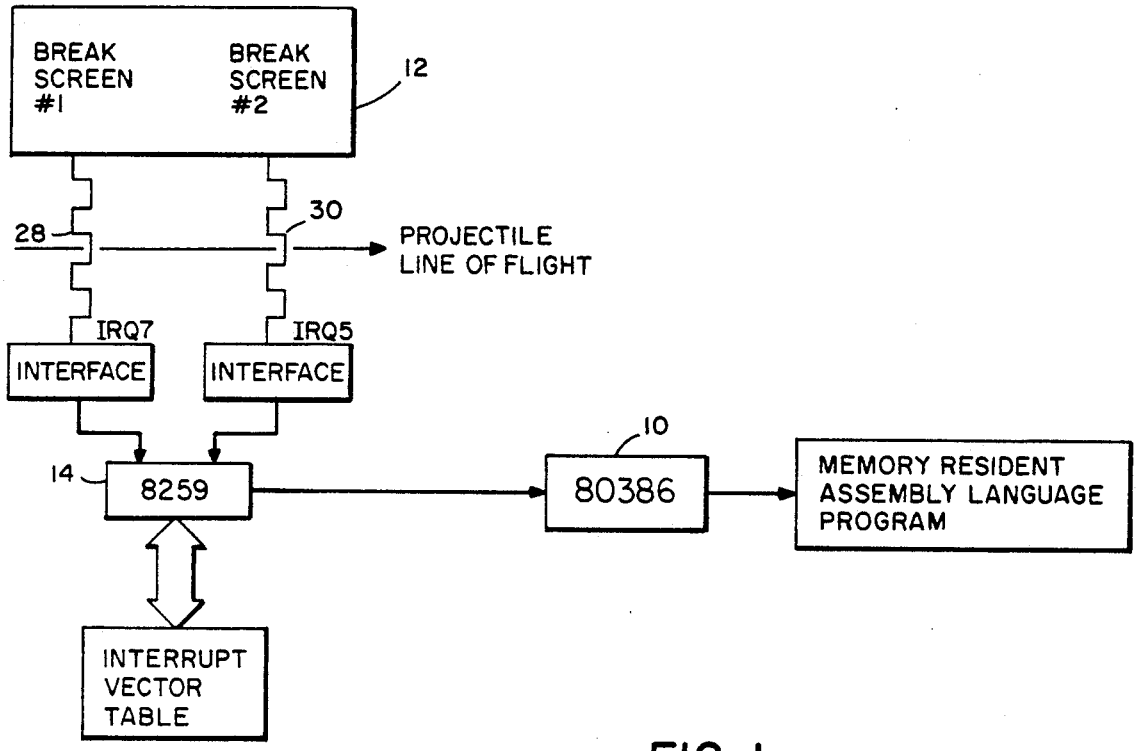
FIG. 1 is a schematic functional view of the arrangement of the present invention.

The system hardware includes a 16 MHZ Compaq Deskpro 386 personal computer 10, an external sensing circuit 12 which detects and sends the two break-screen signals to the computer 10, and interfacing or interrupt circuit 14 which converts 5 volts TTL computer output pulses into 50 volts triggering pulses for the x-ray tubes.

The system software is implemented in the assembly language for time-critical control operations and in a compiled high-level language for the user interface. This system retains the full mathematical capabilities of the microprocessor enabling high speed division and multiplication instructions to perform real-time calculations of the necessary delays for any geometrical set-up, thus imposing practically no restrictions on tube head locations.

The software is divided into two parts. The first part is a user interface program to input the physical layout data (break screen baseline length, flash x-ray tubehead locations) and to output the measured velocity to the operator. The second part is a high speed, memory-resident, assembly language program which accepts the input data from the user interface provided later herein, sets up the 8259 interrupt handler, measures the projectile velocity, generates the appropriate delays, and outputs 5 volts TTL pulses accordingly through external computer ports.

As depicted in FIG. 1, the activation sequence follows. During initialization, the assembly language routines are loaded into memory. The addresses of the incrementation procedure (COUNTUP) and the delay generation procedure (COUNTDOWN) are loaded into the BIOS interrupt vector table which will point the microprocessor to the proper routine upon receiving each interrupt signal. At this point, the microprocessor is placed into a wait state and the system is ready for activation.

When the first screen 28 is broken by the projectile, a signal (IRQ7) is sent to the 8259 interrupt handler 14 which directs the program control, via the BIOS interrupt vector table, to a service routine (COUNTUP) which commences the incrementation of the microprocessor BX register at 8 MHZ until the second screen 30 is broken (IRQ5), whereupon the 8259 directs program control to another service routine (COUNTDOWN) which saves the final tally of the BX register for the velocity measurement, calculates the proper values of the countdown register CX for the delay loops. At the end of each delay loop, a 5 volts TTL pulse is generated through the computer ports for triggering the flash x-ray tube at the proper time. The computer calculates and generates the delay for each tube sequentially.

Figure 2:
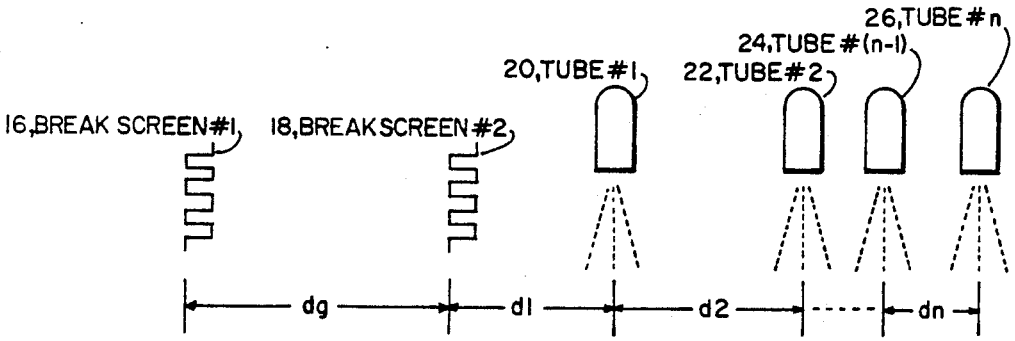
FIG. 2 is a schematic view of a generic tube head arrangement having a break screen used for velocity measuring with tube heads located downrange.

FIG. 2 shows a generic arrangement of a break screen velocity measuring scheme with tube heads located downrange. There is a first break screen 16 and a second break screen 18 and dg represents the break screen baseline length. The term dl is the distance from the 2nd break screen 18 to the first tube head 20. d2 is the distance from the first tube head 20 to the second tube head 22. The term dn is the distance from the nth head 26 to the (n−1)th head 24, etc. Assuming constant velocity:

$$Vg = Vn \qquad \text{Eqn. (1)}$$

$$\frac{dg}{tg} = \frac{dn}{tn} \rightarrow tn = \frac{tg}{(dg/dn)} \qquad \text{Eqn. (2)}$$

where tg and tn are the elapsed times for the projectile to travel distances dg and dn, respectively.

The ratio dg/dn is the distance factor relating the elapsed time measurement to the necessary delay for the next tubehead. Internally, tg is the tally of the microprocessor register, BX, which was incremented at 8 MHZ by the software routine. The delay for each tubehead is created by looping a microprocessor countdown register, CX. This instruction procedure is slower than the incrementation process. It requires two microprocessor clock cycles to increment BX with the INC BX instruction and 13 microprocessor clock cycles to decrement CX with the loop instruction. The COUNTUP and COUNTDOWN procedures occur with different effective clock speeds and a frequency factor must be included to determine the proper value for CX from BX. Summarily:

| Procedure | mP Register | mP Instruction | mP Clock Cycles | Effective Speed |
|---|---|---|---|---|
| Time Measurement | BX | INC BX | 2 | 8 MHZ |
| Delay Generation | CX | LOOP | 13 | 1.23 MHZ |

To illustrate the calculation of the frequency factor, variables bx and cx represent the tallies of register BX and CX, respectively. Since bx is the number of "ticks" of an 8 MHZ clock and cx is the number of "ticks" of a 1.23 MHZ clock, then for any time t:

$$t = \frac{bx}{8} = \frac{Cx}{1.23} \rightarrow \frac{bx}{Cx} = \frac{8}{1.23} = 6.5 \qquad \text{Eqn. (3)}$$

After substitution of these values, Eqn. (3) becomes:

$$Cx = \frac{bx}{(dg/dn)(6,5)} \qquad \text{Eqn. (4)}$$

The frequency factor is 6.5. Eqn (4) shows that the tally of BX must be divided by the distance factor to compensate for the range geometry and the frequency factor to compensate for the different effective clock speeds in the COUNTUP and COUNTDOWN procedures. The resulting value, when loaded into the CX register will generate the proper-delay for the nth x-ray tube.

Thus, the initial value of cx is calculated according to the specific location of the tube head and it is loaded into the cx register. This X-tube is triggered at the end of this COUNTDOWN procedure. This sequence is then repeated for each of the remaining tubeheads. Of course, the projectile does not stop and wait while the initial value of cx is determined. This calculation and the interrupt handling procedures take some time (a few microseconds). Therefore, the program was calibrated for this "overhead" by deducting a few counts from cx before it is loaded into the CX register to initiate the delay LOOP procedures.

The required external hardware was twofold; break screen circuitry to trigger the 8259 interrupts and circuitry to trigger the HP 43115A trigger amplifiers 36 (to be described later in connection with FIG. 3) upon receiving the TTL computer signals. The hardware can be packaged such that different interrupt trigger boards can be interchanged for different projectile actuation schemes: i.e., make screens, break screens, laser beam break, etc.

Figure 3:
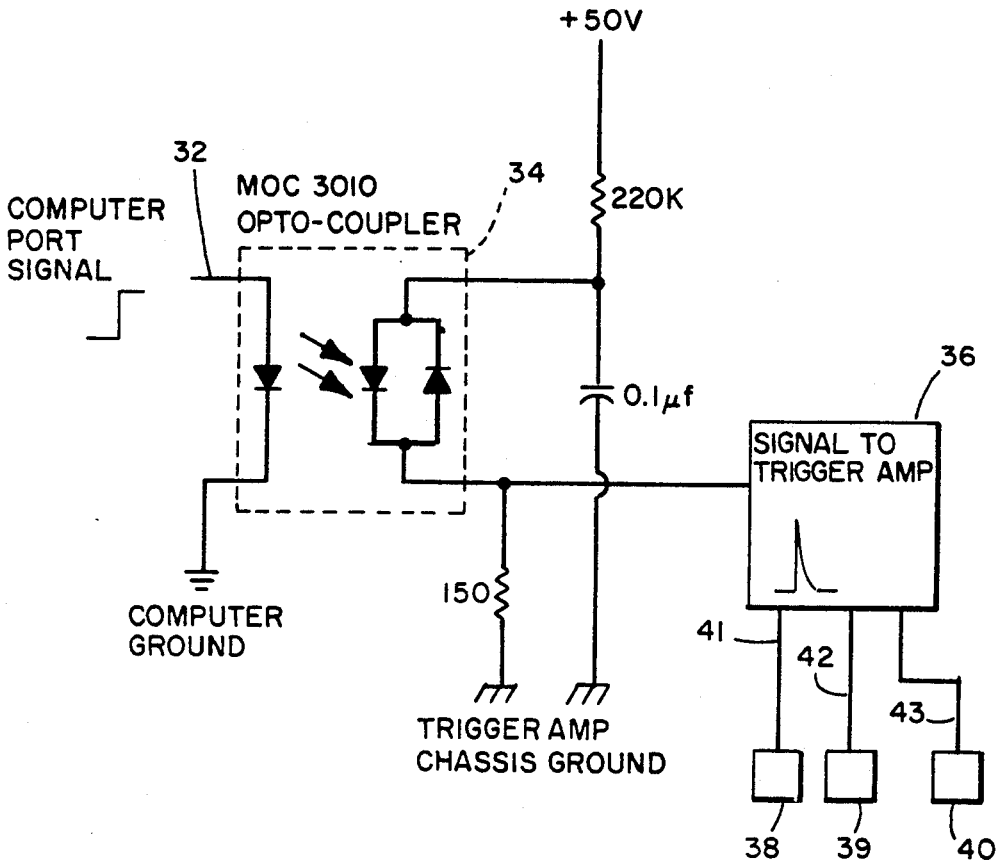
FIG. 3 shows the schematic view of the external circuitry.

FIG. 3 shows the schematic of the external circuitry. At the end of each countdown loop, a logic "high" is sent to a specific pin of the parallel output port 32 to activate the closure of an opto-coupler 34, generating a 50 volt pulse which drives the appropriate HP 43115A trigger amplifier 36 which triggers the flash x-ray pulse to the flash x-ray tubes 38, 39, 40 via lines 41, 42, 43, although a single line for all tubes may be arranged. Any number of flash x-ray tube heads can be activated by this system. The present system utilizes two 8-bit parallel output ports and provides channels to trigger up to 16 tube heads. The computer's parallel printer port can be utilized for this application if desired.

Figure 4:
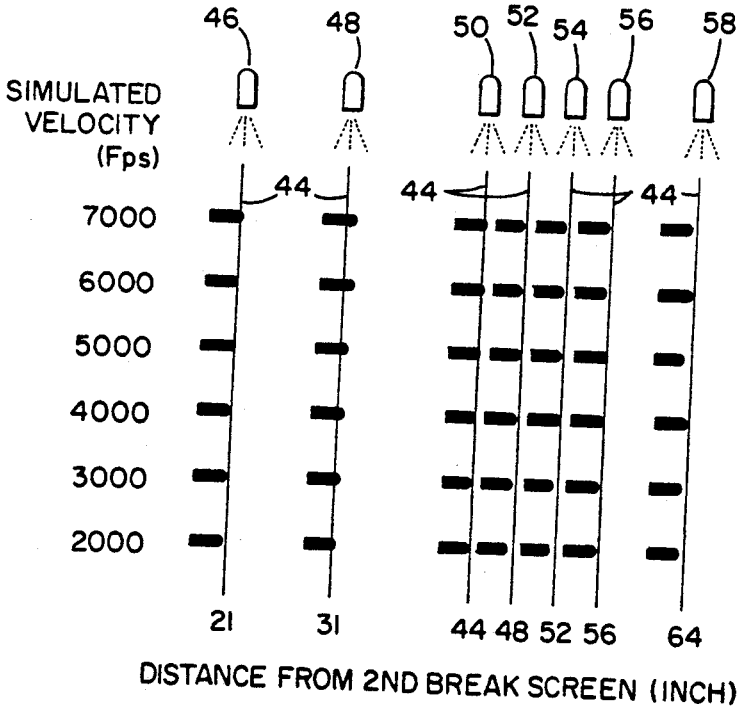
FIG. 4 is a schematic view showing the tube head arrangement as well as the distance from the second break screen.

The system was initially tested by inputting two pulses of a known time interval to simulate the projectile breaking the two break screens at a known velocity. The geometric layout of the ballistic range x-ray tubes was entered into the computer. The controlled input pulses were set to activate the program and the computer output signals were displayed on a digitizing oscilloscope. The actual timing of these delay signals were recorded and compared to the theoretical delay based on the simulated projectile velocity. These delay data can be translated into a series of "in-flight snapshots" of a projectile traveling at that simulated velocity. FIG. 4 represents the results of these simulation tests. The fiducial lines 44 mark the locations of seven x-rays tubes 46, 48, 50, 52, 54, 56 and 58 arbitrarily arranged along the projectile flight path. For a given simulated velocity, the "in-flight" positions of the projectile corresponding to the seven output signals are displayed. The leading edge of the projectile "snapshot" should appear exactly on each fiducial line. As shown in FIG. 4, the largest deviation from the fiducial line 44 was within 0.25 inches for velocities ranging from 2000 to 7000 fps.

After the system was calibrated, it was installed in a ballistic test facility. The system then was tested over a wide range of projectile velocities (1500–6500 fps) and the flash x-rays "captured" the projectile on the radiographs at the desired locations on all occasions.

Thus, a real-time flash x-ray controller has been developed by implementing an assembly language program in a 16 MHZ Compaq 386 personal computer and external hardware which interfaces between the computer and the HP 43115A flash x-ray trigger amplifiers. The system measures the projectile velocity and triggers the x-ray tubes (arbitrarily arranged along the projectile flight path) at the proper times to capture the projectile on radiographs at the desired locations. Because of its flexibility and reliability, the system can be easily adapted to synchronize the time-critical controls of high speed cameras, target instrumentations, and the like. Since the system uses a personal computer, it centralizes the range operations as equipment control and experiment record-keeping become an integral task.

In its broader aspects, the invention can be used to provide a method for measuring the velocity of a fast moving object and providing precision electrical triggering signals to other instruments according to the measured velocity and geometric setup, in which at least two spaced reference points are set up on an axis along which a fast moving object is to be propelled, several spaced action stations are set up along said axis at points spaced randomly therealong and downstream of said reference points, an object is moved along the axis, the time the moving object takes to move from the first reference point to the second reference point is measured, this time is stored in memory, the time it will take the moving object to move from the second reference point to the first spaced action station is calculated according to the measured velocity and geometric setup, a delay procedure to wait for the object to arrive at the first action station is initiated, an electrical triggering signal is provided to the first action station to initiate an action step by the first action station, the time it will take the moving object to move from the first (current) action station to the second (next) action station is calculated, a delay procedure is initiated, an electrical triggering signal is provided to the second (now current) action station, and this process is repeated for each additional action station along the flight path of the fast moving object.

It should be understood that various changes and modifications to the embodiments of the invention as described hereinabove will be apparent to those skilled in the art. Such changes can be made without departing from the spirit and scope of the invention and without diminishing its attendant advantages. It is therefore intended that such changes and modifications be covered by the following claims.

```
;ASSEMBLY LANGUAGE SOFTWARE ROUTINE FOR REAL TIME
;FLASH X-RAY CONTROLLER

;DR. A.L. CHANG, P.M. VINCENT, DR. I.A. MARTORELL

;NOTE: THIS PROGRAM IS DESIGNED TO RUN ON A 16 MHZ 80386
;MICROPROCESSOR BASED MICROCOMPUTER, SUCH AS A COMPAQ 386.
;
;-----------------------------------------------------------------------------;
;USING IRQ7 FOR THE FIRST SIGNAL AND IRQ5 THE SECOND SIGNAL                   ;
;                                                                             ;
;PUT NEW INTERRUPT VECTORS AT 0000:0034 (IRQ5) AND AT 0000:003C               ;
;  (IRQ7)                                                                     ;
;                                                                             ;
;LOAD COUNTUP AT CS:0500 AND COUNTDOWN AT CS:5000                             ;
;                                                                             ;
;USING 15000 INC BX AS A 8 MHZ COUNTER TO MEASURE TIME                        ;
;  BETWEEN 2 PULSES;                                                          ;
;-----------------------------------------------------------------------------;

INC_BX      MACRO

        INC     BX
        INC     BX
        INC     BX
        INC     BX
        INC     BX
;       "
;       "
;       "
;       "
;       "
;       "
```

```
;       (IMPORTANT! THIS COMMAND IS REPEATED 1000 TIMES.)
;       "
;       "
;       "
;       "
;       "
        INC     BX
        INC     BX
        INC     BX
        INC     BX
        INC     BX

        ENDM

;-----------------------------------------------------------------------------------------;

CODESEG     SEGMENT PARA    PUBLIC              ; LOAD CODESEG FIRST

        ASSUME CS:CODESEG,DS:CODESEG
        ORG 100H

ENTRY:      JMP  BINIT

COUNT       DW   0001H
COUNT4      DW   0004H

F1      DW      18
F2      DW      45
F3      DW      45
F4      DW      45
F5      DW      45
F6      DW      45
F7      DW      45
F8      DW      45
STRING1     DB   'BX (TICS)  ELAPSE TIME (MICRO SEC)  VELOCITY (FT/SEC) $'


BINIT       PROC        NEAR

        INTADDR     EQU   03CEH             ; PUT LOW-BYTE OF CS IN 0000:03CE
        JMP     BINITEND

MAIN PROC   FAR

        ORG     200H

        PUSH  ES
        PUSH  DI
        PUSH  SI
        PUSHF

        PUSH  DS
        PUSH  BP
        PUSH  SS
        PUSH  SP
```

```
MOV   BP,SP
MOV   DX,00H

MOV   BX,WORD PTR [BP]+20
MOV   DL, BYTE PTR [BX]
MOV   AH,2
MOV   DS:F1, DX                ; F1%

MOV   BX,WORD PTR [BP]+22
MOV   DL, BYTE PTR [BX]
MOV   AH,2
MOV   DS:F2, DX                ; F2%

MOV   BX,WORD PTR [BP]+24
MOV   DL, BYTE PTR [BX]
MOV   AH,2
MOV   DS:F3, DX                ; F3%

MOV   BX,WORD PTR [BP]+26
MOV   DL, BYTE PTR [BX]
MOV   AH,2
MOV   DS:F4, DX                ; F4%

MOV   BX,WORD PTR [BP]+28
MOV   DL, BYTE PTR [BX]
MOV   AH,2
MOV   DS:F5, DX                ; F5%

MOV   BX,WORD PTR [BP]+30
MOV   DL, BYTE PTR [BX]
MOV   AH,2
MOV   DS:F6, DX                ; F6%

MOV   BX,WORD PTR [BP]+32
MOV   DL, BYTE PTR [BX]
MOV   AH,2
MOV   DS:F7, DX                ; F7%

MOV   BX,WORD PTR [BP]+34
MOV   DL, BYTE PTR [BX]
MOV   AH,2
MOV   DS:F8, DX                ; F8%


MOV   AL,80H                   ; CONFIGURE OUTPUT PORTS

MOV   DX,0307H
OUT   DX,AL

MOV   AL,00H                   ; INITIALIZE X-RAY TRIGGERING PORT
MOV   DX,0304H
OUT   DX,AL
```

```
MOV   AX,00H
MOV   ES,AX

MOV   AX,WORD PTR ES:0030H  ; SAVE OLD INTERRUPT VECTORS
PUSH  AX
MOV   AX,WORD PTR ES:0032H
PUSH  AX
MOV   AX,WORD PTR ES:003CH
PUSH  AX
MOV   AX,WORD PTR ES:003EH
PUSH  AX

MOV   WORD PTR ES:003CH,0500H     ; LOAD IRQ7 VECTOR AT 0000:003C
MOV   WORD PTR ES:003EH,CS        ;  (CS:0500) COUNTUP

MOV   WORD PTR ES:0034H,5000H     ; LOAD IRQ5 VECTOR AT 0000:0034
MOV   WORD PTR ES:0036H,CS        ;  (CS:5000) COUNTDOWN

CLI                               ; DISABLE ALL INTERRUPTS

MOV   AL,11H                      ; RE-INITIALIZE 8259 (MASTER)
OUT   20H,AL                      ; ICW1 - EDGE TRIGGER, ICW4 NEEDED

MOV   AL,08H
OUT   21H,AL                      ; ICW2

MOV   AL,04H
OUT   21H,AL                      ; ICW3 - SLAVE AT IRQ2

MOV   AL,01H
OUT   21H,AL                      ; ICW4 - 8086

MOV   AL,01011101B
OUT   21H,AL                      ; OCW1 - INSTALL MASK: IRQ5,IRQ7,KEYB.

MOV   AL,68H
OUT   20H,AL                      ; OCW3 - SET SPECIAL MASK (SSMM)

MOV   AL,11H                      ; RE-INITIALIZE 8259 (SLAVE)
OUT   0A0H,AL                     ; ICW1 - EDGE TRIGGER, ICW4 NEEDED

MOV   AL,70H
OUT   0A1H,AL                     ; ICW2

MOV   AL,02H
OUT   0A1H,AL                     ; ICW3 - SLAVE ID

MOV   AL,03H
OUT   0A1H,AL                     ; ICW4 - AEOI, 8086

MOV   AL,0FFH                     ; DISABLE SLAVE COMPLETELY
OUT   0A1H,AL                     ; INSTALL MASK

MOV   AL,80H                      ; MASK OFF NMI
OUT   70H,AL
```

```
MOV   DX,0
MOV   BX,0
MOV   AX,0

STI
HLT                          ; WAITING FOR FIRST SIGNAL TO ACTIVATE IRQ7


MOV   AL,11H                 ; RE-INITIALIZE 8259 (MASTER)
OUT   20H,AL

MOV   AL,08H
OUT   21H,AL

MOV   AL,04H
OUT   21H,AL

MOV   AL,01H
OUT   21H,AL
MOV   AL,0B8H
OUT   21H,AL                 ; RESTORE OLD INTERRUPT MASK

MOV   AL,11H                 ; RE-INITIALIZE 8259 (SLAVE)
OUT   0A0H,AL                ; ICW1 - EDGE TRIGGER, ICW4 NEEDED
MOV   AL,70H
OUT   0A1H,AL                ; ICW2
MOV   AL,02H
OUT   0A1H,AL                ; ICW3 - SLAVE ID
MOV   AL,01H
OUT   0A1H,AL                ; ICW4 - 8086

MOV   AL,8DH
OUT   0A1H,AL                ; INSTALL DEFAULT MASK

POP   AX
MOV   WORD PTR ES:003EH,AX ; RESTORE OLD INTERRUPT VECTORS
POP   AX
MOV   WORD PTR ES:003CH,AX
POP   AX
MOV   WORD PTR ES:0036H,AX
POP   AX
MOV   WORD PTR ES:0034H,AX

MOV   AL,00H                 ; RE-ENABLE NMI
OUT   70H,AL

STI

MOV   BX,[BP]+36             ; RETURN COUNT TO BX% IN CALLING PROGRAM
MOV   AX,DS:COUNT
MOV   [BX],AX
```

```
        POP     SP
        POP     SS
        POP     BP
        POP     DS
        POPF
        POP     SI
        POP     DI
        POP     ES

        MOV     DX,304H
        MOV     AL,00H
        OUT     DX,AL

        IRET
        RET     10

MAIN ENDP

COUNTUP     PROC        NEAR

        ORG     500H


        CLI

        MOV     DX,0
        MOV     AX,0

        MOV     BX,52               ; ACCOUNT FOR 7 MICRO SECONDS OVERHEAD
        STI

        INC_BX
        INC_BX
        INC_BX
        INC_BX
        INC_BX
        INC_BX
        INC_BX
        INC_BX
        INC_BX
        INC_BX

        INC_BX
        INC_BX
        INC_BX
        INC_BX
        INC_BX

        IRET
        RET

COUNTUP ENDP


COUNTDOWN       PROC NEAR
```

```
        ORG   5000H

        CLI

        MOV   DS:COUNT,BX          ; SAVE BX IN COUNT
        MOV   AX,BX
        MOV   BX,1
        MUL   BX
        MOV   DS:COUNT4,AX

        MOV   CX,00H
        MOV   DX,00H

        MOV   AX,DS:COUNT4
        DIV   DS:F1

        MOV   DX,304H
        SUB   AX,10D
        MOV   CX,AX
X1:     LOOP  X1
        MOV   AL,00000001B
        OUT   DX,AL
        MOV   DX,00H

        MOV   AX,DS:COUNT4
        DIV   DS:F2
        MOV   DX,304H
        SUB   AX,05D
        MOV   CX,AX
X2:     LOOP  X2
        MOV   AL,00000010B
        OUT   DX,AL
        MOV   DX,00H

        MOV   AX,DS:COUNT4
        DIV   DS:F3
        MOV   DX,304H
        SUB   AX,05D
        MOV   CX,AX
X3:     LOOP  X3
        MOV   AL,00000100B
        OUT   DX,AL
        MOV   DX,00H

        MOV   AX,DS:COUNT4
        DIV   DS:F4
        MOV   DX,304H
        SUB   AX,05D
        MOV   CX,AX
X4:     LOOP  X4
        MOV   AL,00001000B
        OUT   DX,AL
        MOV   DX,00H

        MOV   AX,DS:COUNT4
        DIV   DS:F5
        MOV   DX,304H
        SUB   AX,05D
```

```
X5:     LOOP    X5
        MOV     AL,00010000B
        OUT     DX,AL
        MOV     DX,00H

        MOV     AX,DS:COUNT4
        DIV     DS:F6
        MOV     DX,304H
        SUB     AX,05D
        MOV     CX,AX
X6:     LOOP    X6
        MOV     AL,00100000B
        OUT     DX,AL
        MOV     DX,00H
        MOV     AX,DS:COUNT4
        DIV     DS:F7
        MOV     DX,304H
        SUB     AX,05D
        MOV     CX,AX
X7:     LOOP    X7
        MOV     AL,01000000B
        OUT     DX,AL
        MOV     DX,00H

        MOV     AX,DS:COUNT4
        DIV     DS:F8
        MOV     DX,304H
        SUB     AX,05D
        MOV     CX,AX
X8:     LOOP    X8
        MOV     AL,10000000B
        OUT     DX,AL

        MOV     DX,00H

        STI
        IRET
        RET

COUNTDOWN       ENDP

BINITEND:

        XOR     AX,AX

        MOV     DS,AX
        MOV     AX,CS
        MOV     DS:INTADDR,AX

        PUSH    CS
        POP     DS

        MOV     DX,OFFSET BINITEND+100H
        INT     27H

        BINIT   ENDP

CODESEG         ENDS
        END     ENTRY
```

We claim:

1. A method of performing high speed precision control of action stations used to collect data to assist in the study/analysis of fast moving objects, comprising the steps of:

a. setting up at least two spaced reference points on an axis along which a fast moving object is to be propelled;

b. setting up at least two spaced action stations along said axis at points spaced randomly therealong and downstream of said reference points;

c. moving an object along said axis;

d. measuring the time the moving object takes to move from the first reference point to the second reference point and storing this time in memory;

e. calculating the time it takes the moving object to move from the second reference point to the first spaced action station according to the measured time and geometric setup;

f. initiating a delay procedure to wait for the object to arrive at the first action station and providing an electrical triggering signal to the first action station to initiate an action step in connection with the object moving by the first action station;

g. calculating the time it will take the moving object to move from the first action station to the second action station according to the measured time and the new geometric setup;

h. initiating a delay procedure to wait for the object to arrive at the second action station and providing an electrical triggering signal to the second action station to initiate an action step in connection with the object moving by the second action station; and i. repeating step g through step h for each additional action station.

2. A method for performing high speed precision control of action stations as defined in claim 1, wherein the reference points are places where arrival of the object is sensed.

3. A method for performing high speed precision control of action stations as defined in claim 1, wherein the fast moving object is a projectile.

4. A method for performing high speed precision control of action stations as defined in claim 3, wherein the reference points are break screens.

5. A method for performing high speed precision control of action stations as defined in claim 4, wherein the action stations are flash x-ray tubes spaced along and subsequent to said break screens along said axis.

6. A method for performing high speed precision control of action stations as defined in claim 5, wherein the time-critical measuring, calculating and triggering functions are implemented with a memory-resident assembly language software program.

7. A method for performing high speed precision control of action stations as defined in claim 6, wherein the reference points are laser-photodiode beam-interrupting sensors.

8. A method for performing high speed precision control of action stations as defined in claim 7, wherein the action stations are high speed camera systems.

9. A method for performing high speed precision control of action stations as defined in claim 8, wherein the action stations are target instrumentation circuitry for measuring projectile/target interactions.

* * * * *